US012686096B2

(12) United States Patent
Xie

(10) Patent No.: US 12,686,096 B2
(45) Date of Patent: Jul. 21, 2026

(54) SHARPENER

(71) Applicant: Tirui Xie, Chongqing (CN)

(72) Inventor: Tirui Xie, Chongqing (CN)

( * ) Notice: Subject to any disclaimer, the term of this patent is extended or adjusted under 35 U.S.C. 154(b) by 0 days.

(21) Appl. No.: 19/385,430

(22) Filed: Nov. 11, 2025

(65) Prior Publication Data

US 2026/0115853 A1 Apr. 30, 2026

Related U.S. Application Data

(63) Continuation-in-part of application No. 18/937,192, filed on Nov. 5, 2024, now Pat. No. 12,496,675.

(30) Foreign Application Priority Data

Oct. 29, 2024 (CN) ..... 202411521630.3
Oct. 29, 2024 (CN) ..... 202422623427.9

(51) Int. Cl.

| | |
|---|---|
| ***B24B 19/00*** | (2006.01) |
| ***B24B 3/54*** | (2006.01) |
| ***B24B 41/06*** | (2012.01) |
| ***B24D 15/06*** | (2006.01) |
| ***B24D 15/08*** | (2006.01) |

(52) U.S. Cl.

CPC ..... *B24B 19/002* (2013.01); *B24B 3/543* (2013.01); *B24B 3/546* (2013.01); *B24B 41/066* (2013.01); *B24D 15/065* (2013.01); *B24D 15/08* (2013.01)

(58) Field of Classification Search

CPC .... B24D 15/08; B24D 15/065; B24D 15/063; B24B 41/066; B24B 3/54; B24B 3/543; B24B 3/50; B24B 3/52; B24B 3/546; B25B 5/04; B25B 13/30; B25B 13/32

See application file for complete search history.

(56) References Cited

U.S. PATENT DOCUMENTS 2,644,279 A * 7/1953 Stankovich ..... B24B 41/066 451/380
4,217,735 A * 8/1980 McGeoch ..... B24D 15/06 451/377
5,582,542 A * 12/1996 Stein ..... B24B 15/06 451/367
8,523,638 B2 * 9/2013 Grigsby ..... B24B 27/033 451/555

* cited by examiner

*Primary Examiner* — Makena S Markman
(74) *Attorney, Agent, or Firm* — Birchwood IP

(57) ABSTRACT

A sharpener is provided. The sharpener includes a clamping component, a sharpening seat, a sharpener holder, an arm body, a bearing ring, and a driving component, the clamping component is provided with a first rotating axis and a pair of mirrored clamping arms; one end of the arm body is sleeved on a horizontal rod, and the other end thereof is fixed to the first rotating axis; the bearing ring is sleeved on the arm body, a connecting ear is provided on an outer circumference of the bearing ring. When the driving component pushes the bearing ring to move along the arm body, the two clamping arms are caused to synchronously open and close to clamp or release a cutting tool. This sharpener combines low torque clamping and angle reproduction stability. Thus, it is suitable for precision grinding of various types of cutting tools.

11 Claims, 9 Drawing Sheets

SHARPENER

CROSS-REFERENCE TO RELATED APPLICATIONS

This application is a continuation of U.S. application Ser. No. 18/937,192, filed on Nov. 5, 2024, which claims priority to Chinese Patent Application No. 202411521630.3, filed on Oct. 29, 2024, and Chinese Patent Application No. 202422623427.9, filed on Oct. 29, 2024. Both of which are hereby incorporated by reference in their entireties.

TECHNICAL FIELD

The present disclosure relates to the field of grinding cutting tools, or clamping assembly technologies, and in particular, to a sharpener.

BACKGROUND

Sharpener is a grinding cutting tool used to repair a cutting edge of a cutting tool. When in use, a clamping component holds the cutting tool and moves it relative to a sharpening stone, so that the cutting edge of the cutting tool touches a grinding surface and moves relative to it, achieving the goal of improving the sharpness of the cutting tool. For a sharpener, the clamping component is an important part. The existing clamping components mainly use double-sided locking to facilitate grinding of two side edges of the cutting tool. However, they require the use of an Allen wrench for locking, which is cumbersome to operate. Besides that, there are also problems such as non-durability, short lifespan, and labor-intensive. In this regard, CN120588121A discloses a sharpener that uses an ejector pin (wedge-shaped block) to move in a direction perpendicular to a shaft of the clamping component to push the clamping arm to close, thereby clamping the cutting tool. The operation method is simple, but it requires assistance from a torsion member (such as a torsion spring) to tightly adhere the clamping arm to the ejector pin. Although this is convenient for installing the cutting tool, it increases the thrust that pushes the ejector pin to move, which is not friendly to personnel with small force. At the same time, the two clamping arms are in contact with an inclined side wall of the ejector pin, which often causes the clamping arm to slide along the side wall of the ejector pin, and results in changes in the inclination angle of the cutting tool and affects the sharpening effect.

SUMMARY

To overcome at least one of the above-mentioned shortcomings, the present disclosure provides a sharpener: a rigid linkage is established between two clamping arms and an arm body by a bearing ring and symmetric articulated rods, and a clamping force is generated by a driving component provided on the arm body moving along an axial direction of the arm body, so that the two clamping arms synchronously open and close during the clamping and release process, without relying on elastic torque components to provide a main clamping force, thereby reducing the operating torque and improving the stability of angle reproduction.

The specific scheme of the present disclosure is as follows.

A sharpener, including:

a clamping component, which includes two mirror symmetric clamping arms, a middle of the clamping arms is connected by a first rotating shaft;

a sharpening seat, configured to fix a sharpening stone, a working surface of the sharpening stone is a grinding surface;

a sharpener holder, which is configured to slide back and forth along an axial direction of the sharpening seat, the sharpener holder includes a horizontal rod perpendicular to the axial direction of the sharpening seat and parallel to the grinding surface;

an arm body, one end of the arm body is sleeved on the horizontal rod and slides axially along the horizontal rod and pitches around the horizontal rod, and the other end of the arm body is fixedly connected to the first rotating shaft;

a bearing ring, which is coaxially sleeved outside the arm body and is clearance fit with the arm body, and a connecting ear is provided on an outer circumference of the bearing ring;

symmetrical articulated rods, one end of each of the articulated rods is hinged to the connecting ear, and the other end thereof is hinged to a rear end of corresponding clamping arms;

a driving component, which is provided on the arm body and configured to push the bearing ring to move axially along the arm body, thereby causing the two clamping arms to synchronously open and close through the symmetrical articulated rods to clamp or release a cutting tool.

In an embodiment of the present disclosure, the driving component includes:

a driving nut, which is coaxially sleeved on the arm body and forms a threaded pair with an outer circumference of the arm body;

a first thrust bearing, which is coaxially sleeved on an outer wall of the arm body and is clearance fit with the arm body; the first thrust bearing is provided between the driving nut and the bearing ring, and two end faces of the first thrust bearing are respectively in contact with the driving nut and the bearing ring.

In an embodiment of the present disclosure, the arm body includes a first arm segment and a second arm segment that are arranged coaxially; the sharpener further includes a rotating sleeve component, and the rotating sleeve component includes a rotating sleeve; where the rotating sleeve is connected to the first arm segment through the threaded, and is matched with the second arm segment through a rotatable but axially limited connection, so that when the rotating sleeve is rotated, an axial distance between the first arm segment and the second arm segment is changed along the threaded to adjust an effective length of the arm body and fine tune an angle between the cutting tool and the grinding surface.

In an embodiment of the present disclosure, the arm body includes a first arm segment and a second arm segment that is arranged coaxially with the first arm segment; the sharpener further includes a rotating sleeve component, and the rotating sleeve component includes a rotating sleeve; two ends of the rotating sleeve are rotatably connected to one of the first arm segment and the second arm segment, and rotatably or fixedly connected to the other one of the first arm segment and the second arm segment; when the first arm segment and the second arm segment rotate relative to each other, a total length of the arm body remains unchanged.

In an embodiment of the present disclosure, the rotating sleeve is fixedly connected to the first arm segment, and one end of the second arm segment extends into the rotating sleeve and is clearance fit with the rotating sleeve; the rotating sleeve component further includes a second thrust bearing and a locking cap, where the second thrust bearing is provided inside the rotating sleeve, and two end faces of the second thrust bearing are respectively in contact with end faces of the first arm section and the second arm section; the locking cap is detachably connected to the rotating sleeve and rotatably connected to the second arm segment to a limit an axial movement between the first arm segment and the second arm segment.

In an embodiment of the present disclosure, anti-slip teeth and/or replaceable pads are provided on two opposite side walls of front ends of the two clamping arms.

In an embodiment of the present disclosure, the sharpener further includes a sliding guide component, and the sliding guide component includes a sliding seat, a plurality of rolling elements, and two guide shafts fixed on the sharpening seat and extending along a shaft of the sharpening seat, where the rolling elements comprises rollers or bearings; the rolling elements are divided into two groups, each group corresponds one guide shaft, each guide shaft cooperates with an annular groove an outer circumferential of a corresponding group of rolling element to form multi-point rolling support, thereby guiding the sliding seat to move axially along the sharpening seat; the sharpener holder is fixed on the sliding seat; where each rolling element is provided with at least one annular groove on an outer circumferential for rolling cooperation with the guide shaft.

In an embodiment of the present disclosure, the sharpener holder includes:

two parallel and spaced arranged side brackets, one ends of the two side brackets are fixedly connected to the sliding seat, the two side brackets are both provided with through grooves, and the through grooves are parallel to each other; two ends of the horizontal rod are respectively in contact with side walls of the two side brackets; and a locking bolt, which is arranged along a shaft of the horizontal rod, and a body of the locking bolt passes through the through grooves and is detachably connected to the horizontal rod; after connection, a head of the locking bolt presses against side walls of the side brackets.

In an embodiment of the present disclosure, the sharpener holder includes two parallel and spaced arranged side brackets, ends of the two side brackets are connected to the horizontal rod, and the other ends of the side brackets are articulated to the sliding seat;

where the sharpener further includes an angle adjustment component, and the angle adjustment component includes:

a second rotating shaft, which is configured to be a pivoted shaft that connects the side brackets and the sliding seat;

an arc-shaped through groove, which is configured to be a through hole located on the side brackets and extending around a circumference of the second rotating shaft;

a threaded hole, which is provided on a side wall of the sliding seat, a centerline of the threaded hole is parallel to a centerline of the second rotating shaft;

a threaded rod, one end of the threaded rod extends into the threaded hole and is connected to threaded hole by threads, and the other end of the threaded rod passes through the arc-shaped through groove;

a butterfly nut, which is provided on one side of the side brackets facing away from the sliding seat and connected to the threaded rod by threads;

positioning holes, which are configured to be through holes provided on the side brackets, there are a plurality of positioning holes distributed around a circumference of the second rotating shaft;

a blind hole, which is provided on a side wall of the sliding seat and arranged parallel to the centerline of the second rotating shaft;

an ejector pin, one end of the ejector pin extends into the blind hole and is clearance fit with the blind hole, and the other end of the ejector pin is spherical and extends outside the positioning hole to contact the positioning hole; a size of one side of the ejector pin outside the blind hole is larger than that of the positioning hole, so that only a part of the ejector pin is embedded in the positioning hole and is clearance fit the positioning hole;

a spring, where one end of the spring in contact with an inner bottom of the blind hole, and the other end thereof in contact with the ejector pin;

when the side brackets rotate around the second rotating shaft, the ejector pin expands and contracts along a shaft of the blind hole under an action of a spring force; when one end of the ejector pin outside the blind hole is facing the positioning hole, the ejector pin springs in to achieve prepositioning.

In an embodiment of the present disclosure, the sharpener further includes:

two second limiting elements, and two second limiting elements are arranged at intervals along a shaft of the sharpener holder;

a first limiting element, which is provided on the sliding seat and between the two second limiting elements; the first limiting element abuts against any one of the second limiting elements during a reciprocating stroke to limit a stroke and prevents the cutting tool from detaching from the grinding surface of the sharpening stone.

Beneficial Effects

The present disclosure achieves clamping force transmission through the combination of the bearing ring and the symmetrical articulated rods, allowing the two clamping arms to synchronously open and close during the clamping/release process, achieving low torque operation without relying on elastic torque components to provide the main clamping force; the geometric linkage between the bearing ring and the symmetrical articulated rods centers the clamping line and suppresses relative slip, thereby improving the stability of an inclination angle of the cutting tool and the reproducibility of the cutting-edge angle.

The present disclosure uses a multi-point rolling guide formed by two light rods and the plurality of rollers and/or bearings with U-shaped groove, with low friction and anti-swing reciprocating stroke; pre-positioning with continuous locking, quick angle setting and stable locking; the rotating sleeve fine-tuning mechanism achieves continuous angle fine-tuning by changing the effective length of the arm body, which complements the indexing positioning and is suitable for precision grinding of a plurality of types of cutting tools.

Figure 1:
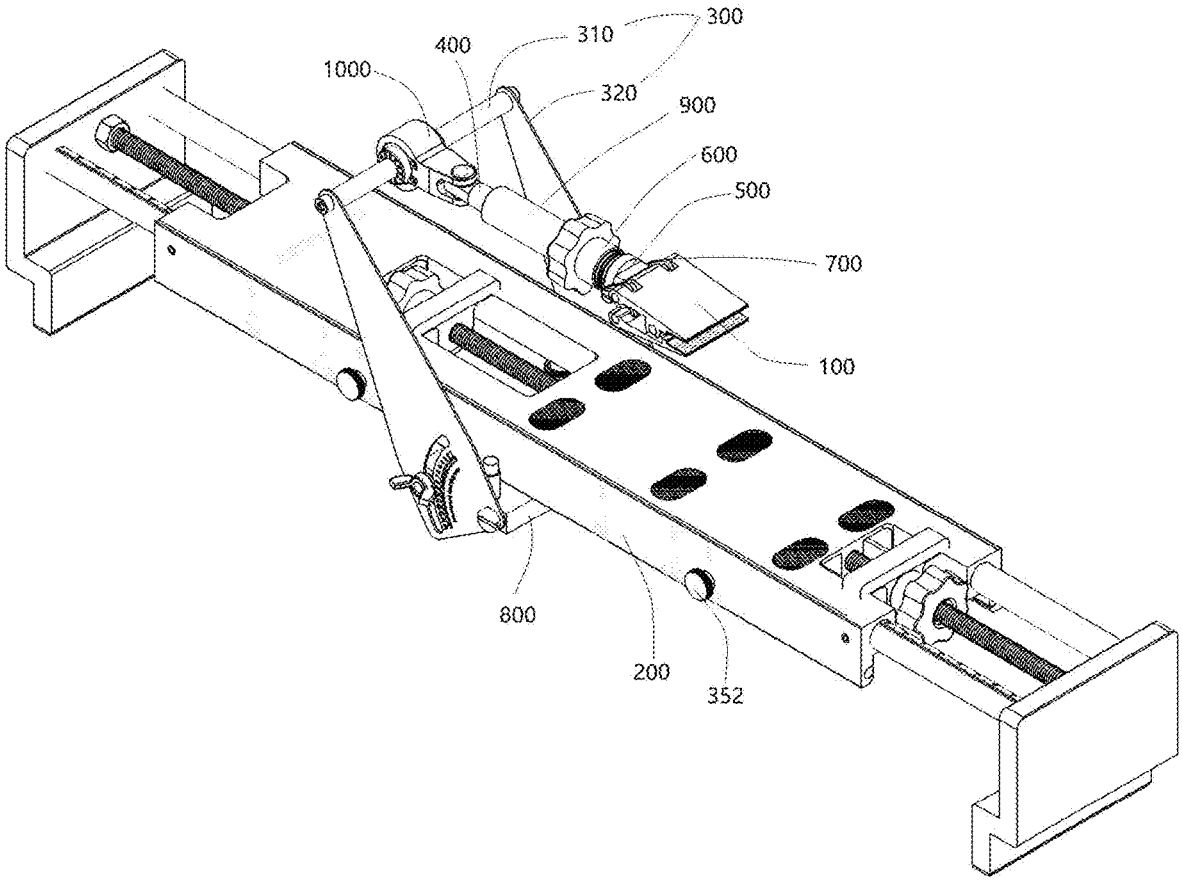
FIG. 1 is a schematic diagram of a three-dimensional structure of a sharpener according to an embodiment of the present disclosure from a first perspective.
Figure 2:
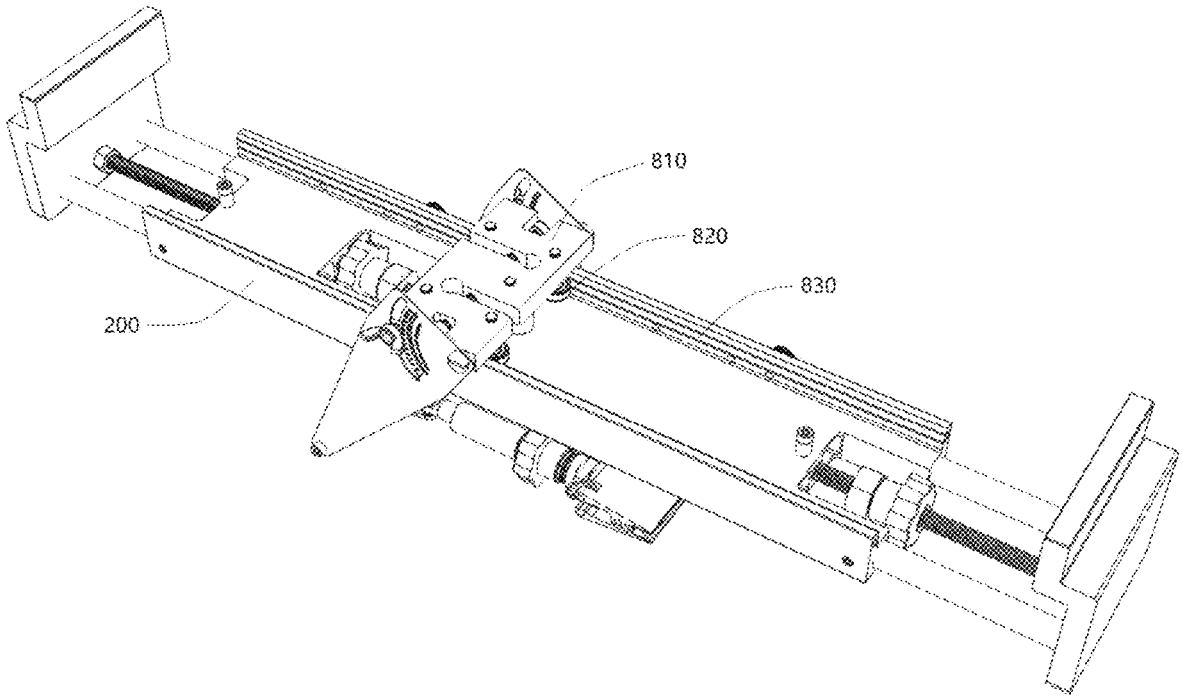
FIG. 2 is a schematic diagram of a three-dimensional structure of the sharpener shown in FIG. 1 from a second perspective.
Figure 3:
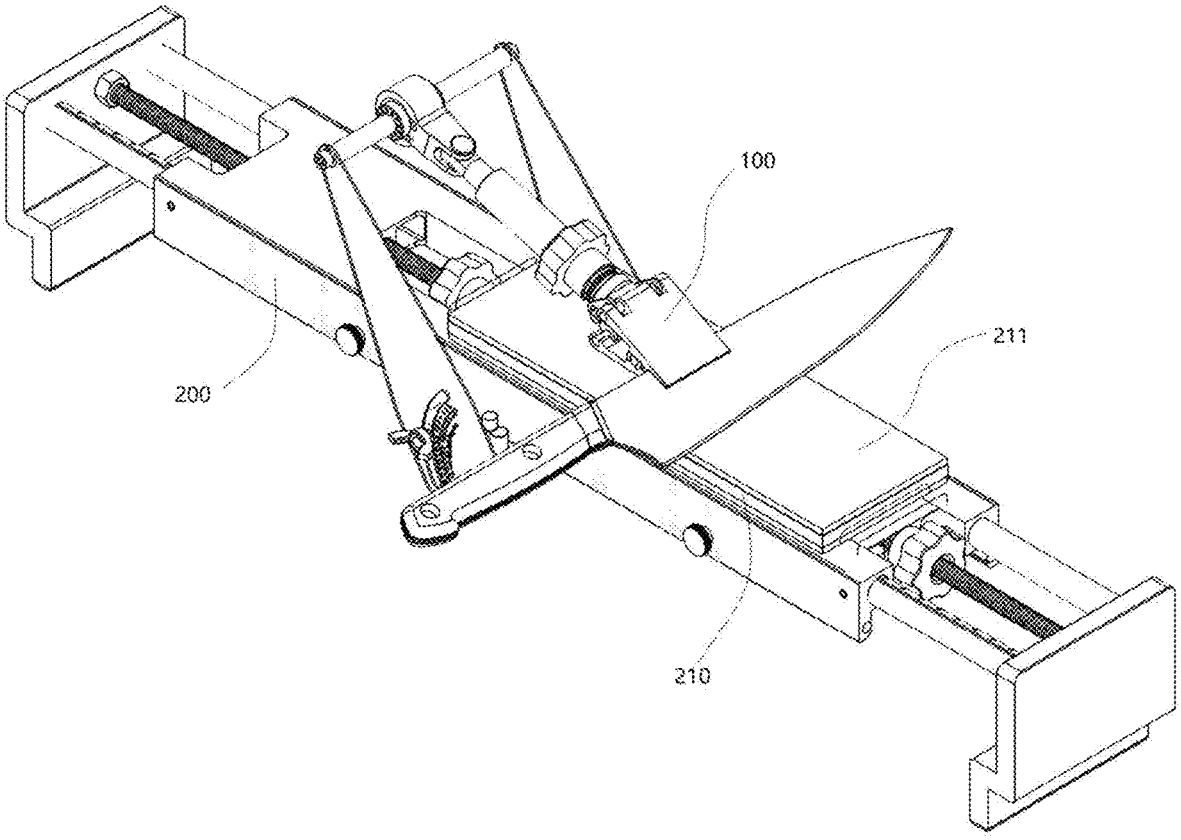
FIG. 3 is a schematic diagram of a state of the sharpener shown in FIG. 1 when holding a cutting tool and installing a sharpening stone.

Numeral reference: clamping component 100; first rotating shaft 110; clamping arm 120; front end of the clamping arm 121; rear end of the clamping arm 122; anti-slip teeth 130; sharpening seat 200; sharpening stone 210; grinding surface 211; sharpener holder 300; horizontal rod 310; side bracket 320; locking bolt 330; arm body 400; first arm segment 410; second arm segment 420; circular convex platform 421; bearing ring 500; connecting ear 501; driving component 600; driving nut 610; first thrust bearing 620; articulated rod 700; sliding guide component 800; sliding seat 810; U-shaped bearing 820; U-shaped groove 821; light rod 830; rotating sleeve component 900; rotating sleeve 910; locking cap 920; second thrust bearing 930; rotating joint 1000; slip-pitch joint 1010; lateral pivot joint 1020; pivot pin 1021; second rotating shaft 341; arc-shaped through groove 342; threaded rod 343; threaded hole 344; butterfly nut 345; ejector pin 346; positioning hole 347; blind hole 348; spring 349; first limiting element 351; second limiting element 352.

DESCRIPTION OF EMBODIMENTS

The present disclosure will be further described in detail with reference to the embodiments and accompanying drawings, but the implementation modes of the present disclosure are not limited to these.

Please refer to FIGS. 1 to 12, which illustrate a structure of an embodiment of a sharpener of the present disclosure. The sharpener of the present disclosure includes a clamping component 100, a sharpening seat 200, a sharpener holder 300, an arm body 400, a bearing ring 500, a driving component 600, and at least one pair of articulated rods 700. The clamping component 100 is used to clamp a cutting tool to be sharpened, and it includes a first rotating shaft 110 and two clamping arms 120. The two clamping arms 120 are symmetrically arranged in a mirror image, and their middle parts are hinged through the first rotating shaft 110. Front ends 121 of the two clamping arms form jaws for clamping the cutting tool. The sharpening seat 200 is used to fix the sharpening stone 210, and a working surface of the sharpening stone 210 (one side used for grinding a blade) is called a grinding surface 211. The sharpener holder 300 can slide axially along the sharpening seat 200, thereby driving the blade to slide relative to the grinding surface 211 and grind the blade. The sharpener holder 300 includes a horizontal rod 310 that is perpendicular to a shaft of the sharpening seat 200 and parallel to the grinding surface 211. A distance between the horizontal rod 310 and the grinding surface 211 can be adjusted to facilitate the adjustment of the angle between the blade and the grinding surface 211, and to control the cutting-edge angle after grinding. One end of the arm body 400 is sleeved on the horizontal rod 310 and can slide along a shaft of the horizontal rod 310 and pitch around the horizontal rod 310. The other end thereof is fixedly connected to the first rotating shaft 110, so that the arm body 400 can drive the clamping component 100 to move along the shaft of the horizontal rod 310 and move around its circumference for easy disassembly, installation, and grinding of cutting tools. At the same time, the arm body 400 is arranged in a direction perpendicular to a shaft of the first rotating shaft 110, and one end of the arm body 400 is fixedly connected to the first rotating shaft 110. The bearing ring 500 is coaxially sleeved outside the arm body 400 and is clearance fit with the arm body 400, so the bearing ring 500 can move axially along the arm body 400. Each pair of articulated rods 700 respectively connects the bearing ring 500 to the rear end 122 of each clamping arm, so as to cause the two clamping arms 120 to symmetrically open and close when the bearing ring 500 moves along the axial direction of the arm body 400. The driving component 600 is provided on the arm body 400, used to push the bearing ring 500 to move axially along the arm body 400, so that the bearing ring 500 drives the two clamping arms 120 to synchronously open and close, to load or release the cutting tool.

In the present disclosure, the bearing ring 500 is a circular closed body structure that can directly drive the clamping arms 120 to symmetrically open and close without the need for torque components, which can significantly reduce labor. At the same time, the clamping arms 120 and the bearing ring 500 move synchronously through the articulated rods 700, avoiding the clamping arms 120 from sliding relative to the bearing ring 500 during the sharpening process, thereby maintaining a stable inclination angle of the cutting tool and facilitating control of a cutting-edge angle.

In an implementation mode, the sharpening stone 210 is detachably fixed to the sharpening seat 200 for easy replacement of vulnerable parts/consumables—the sharpening stone 210, and the specific fixing method can be bolting fixing or buckle fixing.

In an implementation mode, anti-slip teeth 130 are provided on two opposite side walls of front ends 121 of the two clamping arms to grip the cutting tool and improve the stability of the clamping. Of course, pads can also be provided here, and these components can be connected to the clamping arms 120 through screws or dovetail quick release for easy disassembly and replacement.

Figure 5:
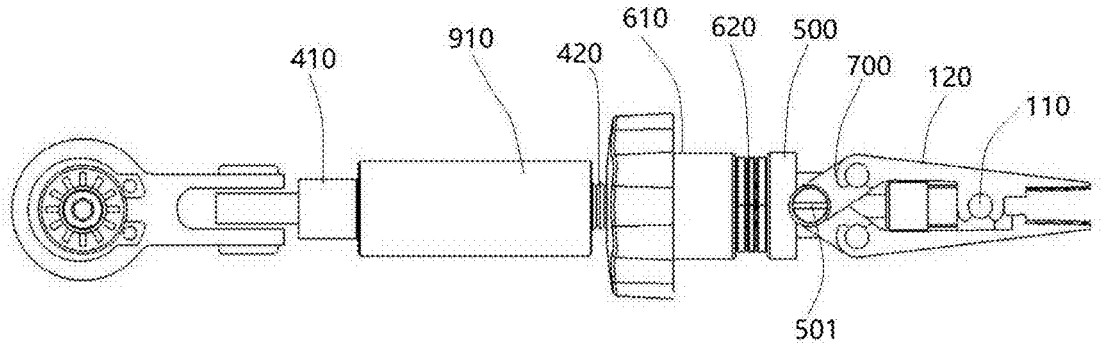
FIG. 5 is a front view of FIG. 4.
Figure 6:
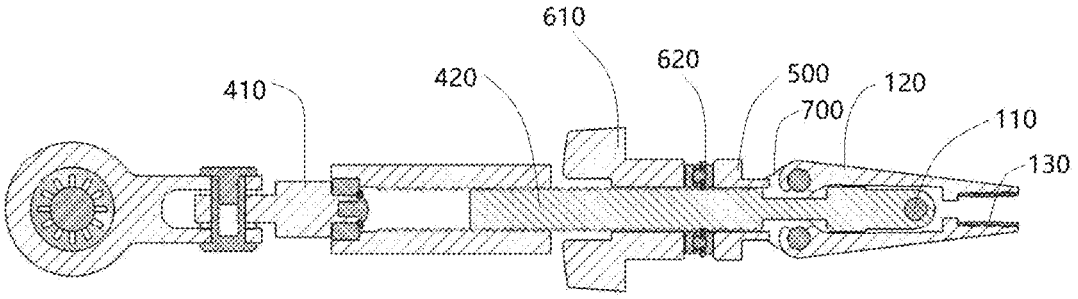
FIG. 6 is a sectional view of FIG. 5.

In an implementation mode, as shown in CN120588121A, the driving component 600 can be a telescopic driving component. For example, the driving component 600 is fixed on the arm body 400, and a telescopic end of the driving component 600 is connected to the bearing ring 500. An axial movement of the bearing ring 500 along the arm body 400 is controlled by a telescopic motion of the driving component 600. The specific telescopic driving component can be a linear actuator, etc. In an implementation mode, the driving component 600 includes a driving nut 610 coaxially sleeved on the arm body 400 and an external thread located on an outer wall of the arm body 400. An internal thread of the driving nut 610 cooperates with an external thread of the outer wall of the arm body 400 to achieve a threaded connection. By rotating the driving nut 610, the opening and closing of the clamping component 100 can be controlled. For example, if it rotates in one of clockwise and counterclockwise directions, the driving nut 610 moves along an axial direction of the arm body 400 towards one end close to the first rotating shaft 110, applies an axial thrust to the bearing ring 500, and the bearing ring 500 moves along the arm body 400 accordingly. The two clamping arms 120 are synchronously approaching together to clamp the cutting tool through the symmetrical articulated rods 700. If it rotates in the other direction, the driving nut 610 moves along one side of the arm body 400 away from the first rotating shaft 110 in an axial direction, and the two clamping arms 120 move synchronously in an opposite direction to release the cutting tool. In an implementation mode, as shown in FIGS. 5 and 6, the driving component 600 may further include a first thrust bearing 620 coaxially sleeved on the outer wall of the arm body 400. The first thrust bearing 620 is clearance fit with the outer wall of the arm body 400, so that it can move axially along the arm body 400. At the same time, the first thrust bearing 620 is located between the driving nut 610 and the bearing ring 500, and the two end faces of the first thrust bearing 620 are respectively in contact with the driving nut 610 and the bearing ring 500, thereby reducing a torque of the rotating driving nut 610 and further reducing physical requirements during the tightening and disassembling of the cutting tool.

Figure 10:
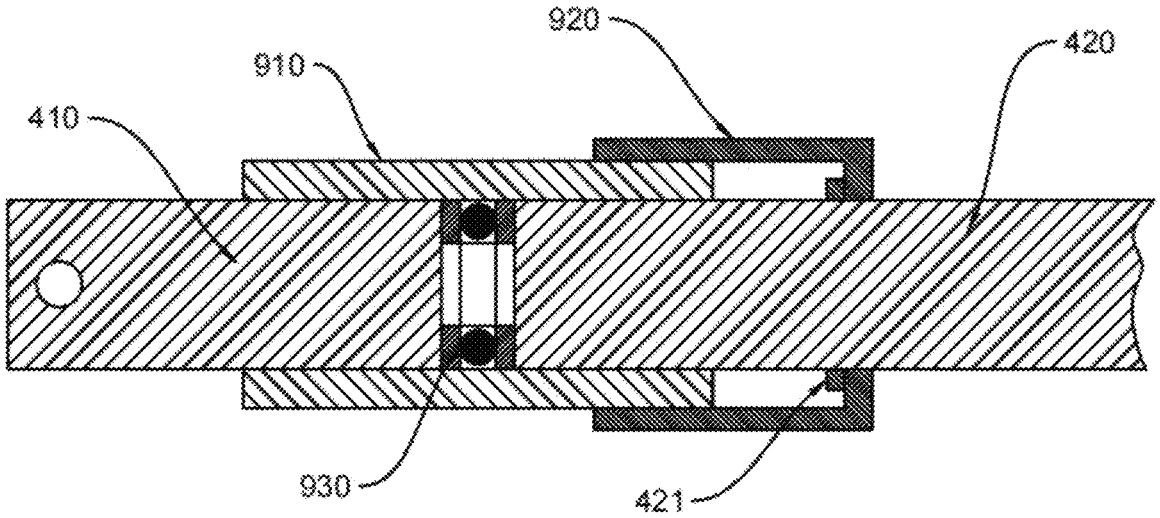
FIG. 10 is a schematic structural diagram of an arm body of the sharpener in another embodiment of the present disclosure.
Figure 11:
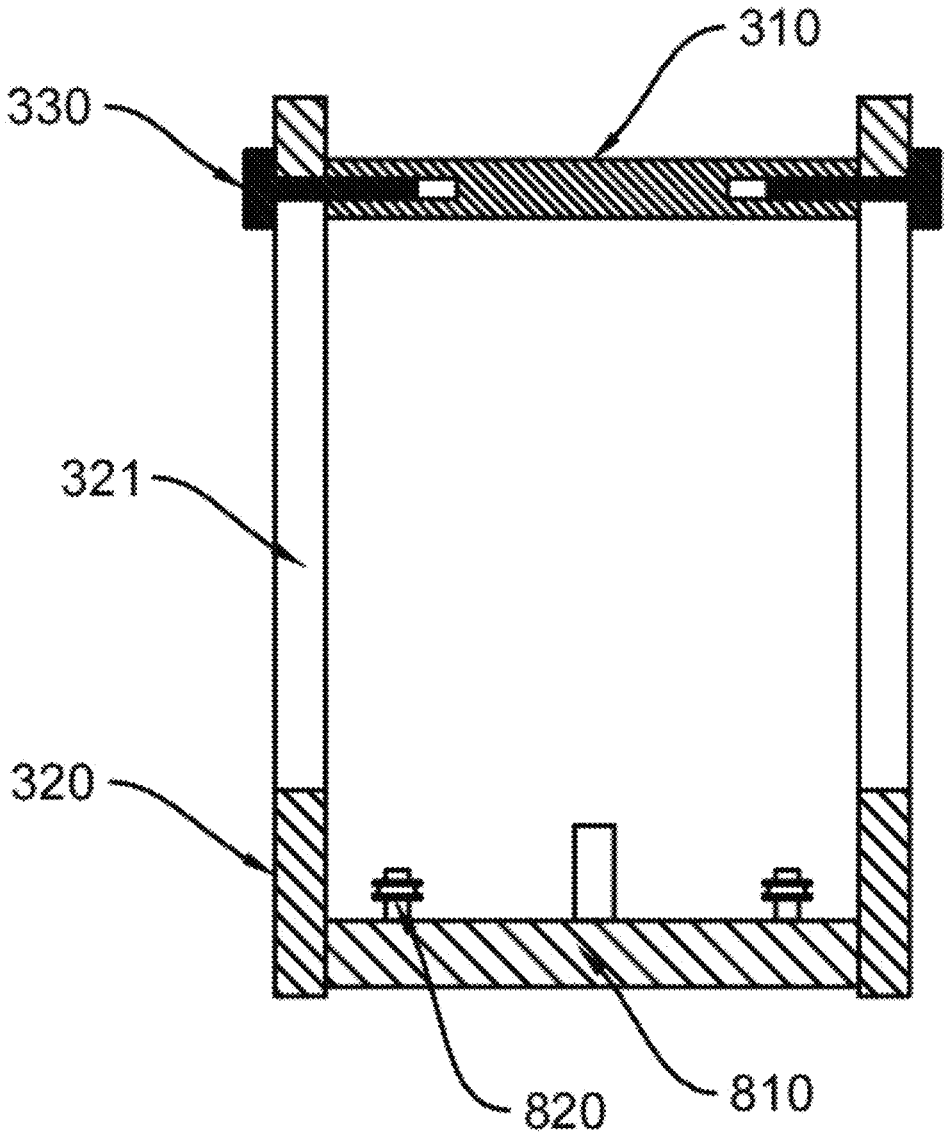
FIG. 11 is a schematic structural diagram of a sharpener holder of the sharpener in another embodiment of the present disclosure.
Figure 12:
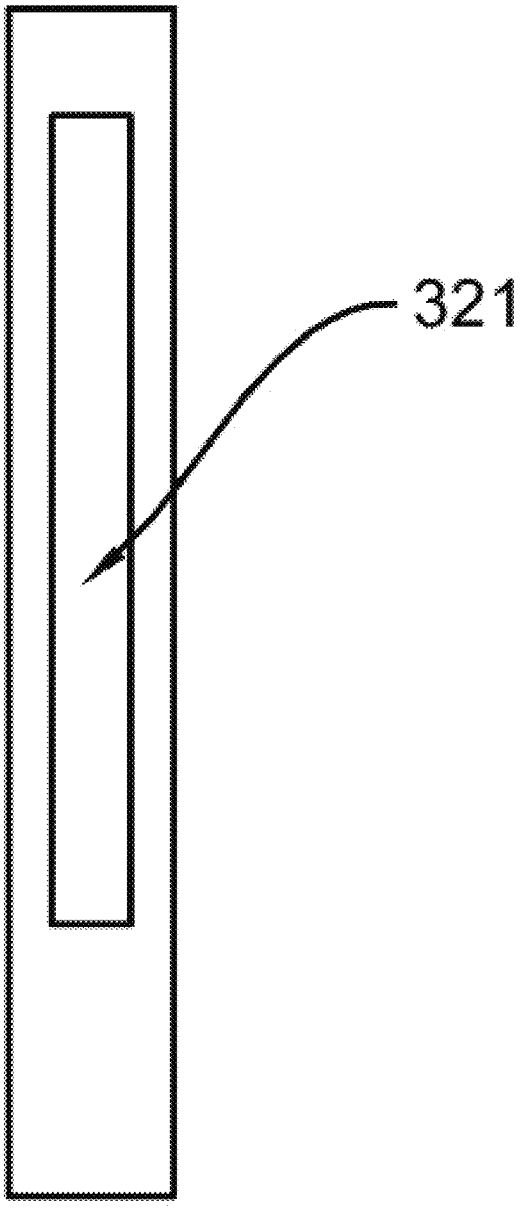
FIG. 12 is a front view of side brackets in the sharpener holder shown in FIG. 11.

In the present disclosure, when one side of the cutting tool is ground to a target state, the cutting tool can be disassembled, then flipped 180° and re-installed to grind the other side, but this involves a cumbersome disassembly and installation process. In order to facilitate a quick grinding of the two sides of the blade, in an implementation mode, as shown in CN120588121A, the arm body 400 includes a first arm segment 410 and a second arm segment 420 that are arranged coaxially, which are connected by a rotating sleeve component 900. The rotating sleeve component 900 includes a rotating sleeve 910, and the rotating sleeve 910 is fixedly connected to one of the first arm segment 410 and the second arm segment 420, and the other is threaded connected, so that the first arm segment 410 and the second arm segment 420 can rotate relative to each other (i.e., two ends of the arm body 400 can rotate relative to each other). In this way, the cutting tool can be quickly flipped by a relative rotation of the first arm segment 410 and the second arm segment 420. However, it should be noted that in this method, the relative rotation of the two arm bodies will cause a slight change in the length of the entire arm body 400, resulting in a change in the inclination angle of the cutting tool and ultimately affecting a cutting-edge angle. Therefore, although an effective length of the arm body can be adjusted through this thread pair to achieve slight adjustment of the cutting-edge angle, if a length of the arm body is changed after flipping, it will result in inconsistent cutting edges on two sides, affecting symmetry and stability. This will disrupt the symmetry and stability of the cutting tool. In an implementation mode, the arm body 400 includes a first arm segment 410 and a second arm segment 420, which are coaxially arranged. At the same time, a rotating sleeve component 900 is further provided, and the rotating sleeve component 900 includes a rotating sleeve 910. However, the rotating sleeve 910 is rotatably connected to one of the first arm segment 410 and the second arm segment 420, and the other is rotatably or fixedly connected, so that two ends of the arm body 400 can rotate relative to each other without changing an overall length of the arm body 400 during a rotation process. For ease of installation and use, in an implementation mode, the rotating sleeve 910 is fixedly connected to the first arm segment 410, and one end of the second arm segment 420 extends into the rotating sleeve 910 and is clearance fit with the rotating sleeve 910. The rotating sleeve component 900 further includes a second thrust bearing 930 and a locking cap 920, the second thrust bearing 930 is arranged inside the rotating sleeve 910, and two end faces of the second thrust bearing 930 are respectively in contact with end faces of the first arm segment 410 and the second arm segment 420. The locking cap 920 is detachably connected to the rotating sleeve 910 and rotatably connected to the second arm segment 420 to limit an axial movement between the first arm segment 410 and the second arm segment 420. In an implementation mode, as shown in FIG. 10, a circular convex platform 421 can be provided in a middle of the second arm segment 420, and the locking cap 920 can be pressed against the circular convex platform 421 to apply an axial thrust to the second arm segment 420, so that the two arm bodies are pressed against each other. The rotating sleeve 910 and the locking cap 920 can be connected by screw thread or other methods.

In an implementation mode, the arm body 400 is connected to the horizontal rod 310 through a rotating joint 1000, as shown in CN120588121A. The rotating joint 1000 may include a slip-pitch joint 1010 and/or a lateral pivot joint 1020. The slip-pitch joint 1010 enables the arm body 400 to slide axially on the horizontal rod 310 and pitch (rotate around its circumference). The slip-pitch joint 1010 can be a bearing structure, etc. The lateral pivot joint 1020 is a pivot structure, and its shaft (pivot pin 1021) is arranged in a direction perpendicular to a shaft of the horizontal rod, so that the arm body 400 can swing laterally in left and right directions of the sharpening seat. In this way, the slip-pitch joint 1010 and the lateral pivot joint 1020 together form a multi-degree of freedom motion along the grinding frame so as to meet the needs of large angle left and right swinging during the grinding process. Large angle left and right swinging ensures that cutting tools of different lengths can be ground on the grinding stone, thereby achieving adaptive grinding of various blade shapes.

Figure 7:
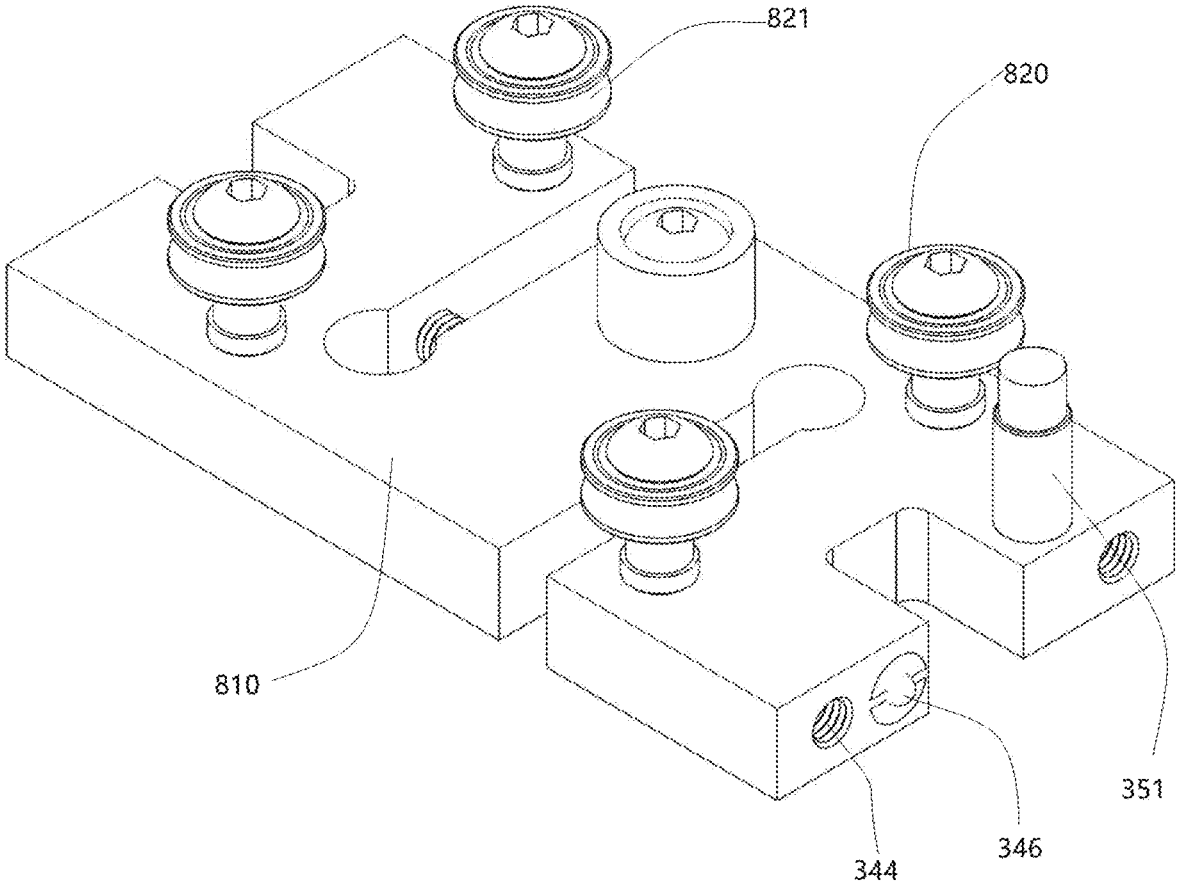
FIG. 7 is a schematic diagram of a three-dimensional structure of a sliding seat in FIG. 1.
Figure 8:
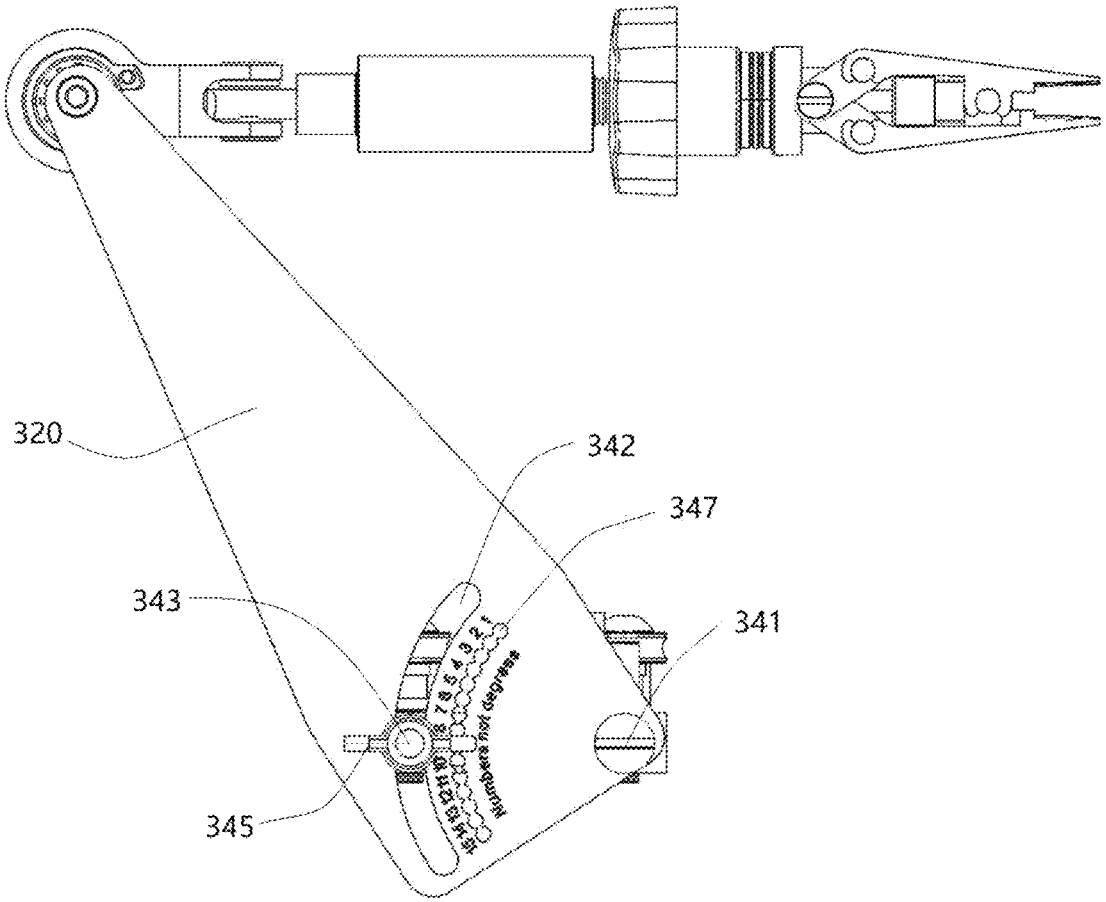
FIG. 8 is a schematic structural diagram of an angle adjustment component in FIG. 1.
Figure 9:
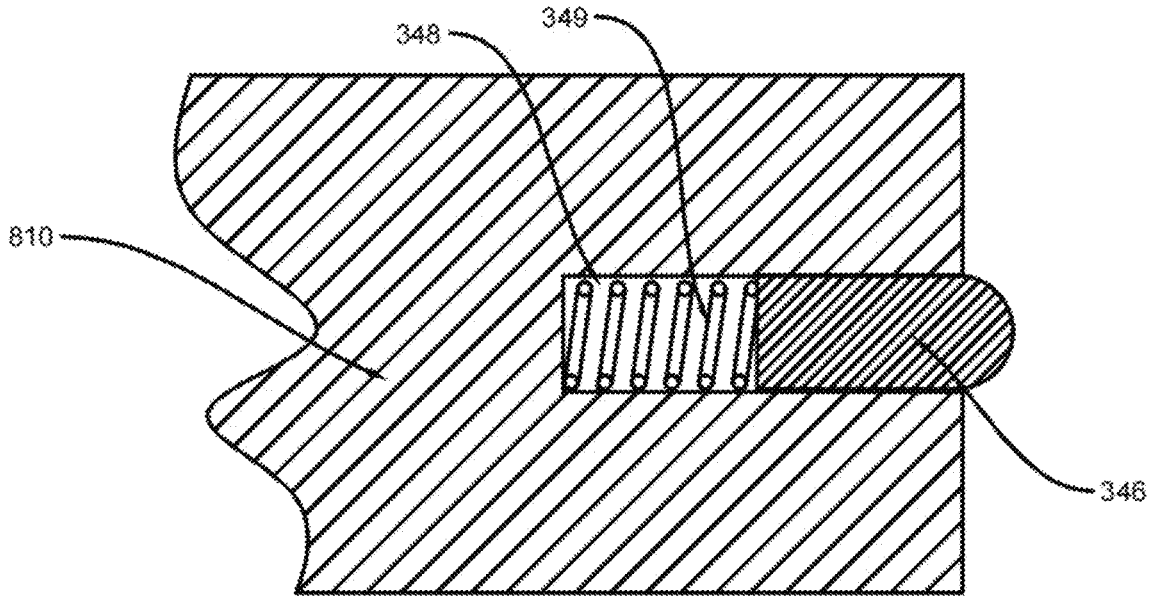
FIG. 9 is a schematic diagram of a combination structure of an ejector pin and a spring in the angle adjustment component of FIG. 8.

In an implementation mode, the configuration shown in CN120588121A can be used to achieve sliding of the sharpener holder 300 relative to the sharpening seat 200. In an implementation mode, a sliding guide component 800 is provided to guide the sharpener holder 300 to slide axially along the sharpening seat. The sliding guide component 800 includes a sliding seat 810, a plurality of U-shaped bearings 820, and two light rods 830 fixed on the sharpening seat 200 and extending axially on the sharpening seat 200. All U-shaped bearings 820 are divided into two groups, each group corresponds to one light rod 830. The light rods 830 are embedded in a U-shaped groove 821 on an outer wall of the corresponding U-shaped bearing 820, thereby guiding the sliding seat 810 to move axially along the sharpening seat 200. The sharpener holder 300 is fixed on the sliding seat 810, so that it can be driven to slide axially relative to the sharpening seat 200 through the sliding seat 810. The number of U-shaped bearings 820 can be selected according to needs, as shown in FIG. 7. It adopts four U-shaped bearings 820, and the light rods 830 are embedded in the corresponding U-shaped groove 821 on an outer circumference of the U-shaped bearing 820 to form a four-point rolling support. In an implementation mode, the light rods 830 and the sliding seat 810 are both provided on one side of the sharpening seat 200 away from the sharpening stone 210, which can prevent mud or iron filings generated during the sharpening process from falling onto the two guide members and affecting the sliding of the sliding seat 810.

In an implementation mode, the sharpener holder 300 adopts a configuration as shown in CN120588121A, and the sharpener holder 300 includes two parallel and spaced side brackets 320. One end of the two side brackets 320 is connected to the horizontal rod 310, and the other end is hinged to the sliding seat 810, so that a distance between the horizontal rod 310 and a surface of the sharpening seat 200 can be changed by rotating the side brackets 320, thereby changing an angle between the blade and the grinding surface 211. In an implementation mode, in order to facilitate the determination of a rotation amplitude of the horizontal rod, an angle adjustment component is provided, and the angle adjustment component includes a second rotating shaft 341, an arc-shaped through groove 342, a threaded rod 343, a threaded hole 344, a butterfly nut 345, an ejector pin 346, a positioning hole 347, and a blind hole 348. The side brackets 320 are pivoted connected to the sliding seat 810 through the second rotating shaft 341, and the arc-shaped through groove 342 is a through hole located on the side brackets 320 and extending around a circumference of the second rotating shaft 341. A centerline of the threaded rod 343 is parallel to a centerline of the second rotating shaft 341, and one end of the threaded rod 343 extends into the threaded hole 344 located on a side wall of the sliding seat 810 and is threaded with the threaded hole 344, and the other end passes through the arc-shaped through groove 342 and is threaded with the butterfly nut 345 by threads. The butterfly nut 345 is used to press the side brackets 320 and sliding seat 810 tightly, thereby achieving the purpose of locking. The positioning hole 347 is also a through hole and located on the side bracket 320. There are a plurality of positioning holes 347, and all positioning holes 347 are distributed around the circumference of the second rotating shaft 341. The blind hole 348 is located on one side wall of the sliding seat 810 and arranged parallel to the centerline of the second rotating shaft 341. One end of the ejector pin 346 extends into the blind hole 348 and is clearance fit with blind hole 348, and the other end thereof is spherical and extends outside the positioning hole 347 to contact the positioning hole 347. One end of the spring 349 abuts against an inner bottom of the blind hole 348 and the other end abuts against the ejector pin 346, thereby forming a spring-loaded positioning ejector pin used to push the ejector pin 346 to move outside the positioning hole 347. The ejector pin 346 is provided in the blind hole 348 of the sliding seat 810, and the spring 349 applies an axial thrust between a bottom of the blind hole 348 and a tail end of the ejector pin 346 to push the ejector pin 346 outward towards the blind hole 348. A ball end of the ejector pin 346 extends from an opening of the blind hole, a diameter of the opening is larger than an aperture of the positioning hole 347, and the ejector pin 346 is only partially embedded in the positioning hole 347 (cannot penetrate the positioning hole 347) and supported by an edge of the positioning hole 347. When the side brackets 320 rotate around the second rotating shaft 341, the ejector pin 346 expands and contracts axially along the blind hole 348 under an action of a spring force. When the ball end of the ejector pin 346 is aligned with any positioning hole 347, the ejector pin 346 is bounced into the hole to form the ejector pin 346. When it is out of position, it is pushed out by an edge of the positioning hole and continues to move with the side brackets 320.

In an implementation mode, the sharpener holder 300 includes two parallel and spaced side brackets 320, ends of side brackets 320 are fixedly connected to the sliding seat 810. The two side brackets 320 are provided with through grooves 321, and the through grooves 321 on the two side brackets 320 are parallel to each other. The two ends of the horizontal rod 310 are respectively in contact with side walls of the two side brackets 320. A rod body of the locking bolt 330 passes through the through groove 321 and is threaded with the horizontal rod 310. After connection, a head of the locking bolt 330 presses though side walls of the side brackets 320, thereby fixing the horizontal rod 310 on the side brackets 320. When the locking bolt 330 is loosened, the horizontal rod 310 can be moved along the through groove 321 to adjust a distance between the horizontal rod 310 and the grinding surface.

In an implementation mode, the sharpening seat 200 is further provided with a retractable bracket to facilitate its fixation on a water bucket containing grinding waste. There are many specific structures, such as the configuration shown in CN120588121A.

In an implementation mode, a first limiting element 351 can further be provided on the sliding seat 810, and second limiting elements 352 can be provided on a side wall of the sharpening seat 200. There are two second limiting elements 352, and the two second limiting elements 352 are arranged at a certain distance along an axial direction of the sharpening seat 200. The first limiting element 351 is provided between the two second limiting elements 352, and the second limiting elements 352 are provided on a path of the first limiting element 351 sliding along the sliding seat 810. When the first limiting element 351 abuts against any one second limiting element 352, the cutting tool is held on the sharpening stone 210, thereby using the two second limiting elements 352 to limit a movement range of the first limiting element 351 and avoid the cutting tool falling from the sharpening stone 210.

Figure 4:
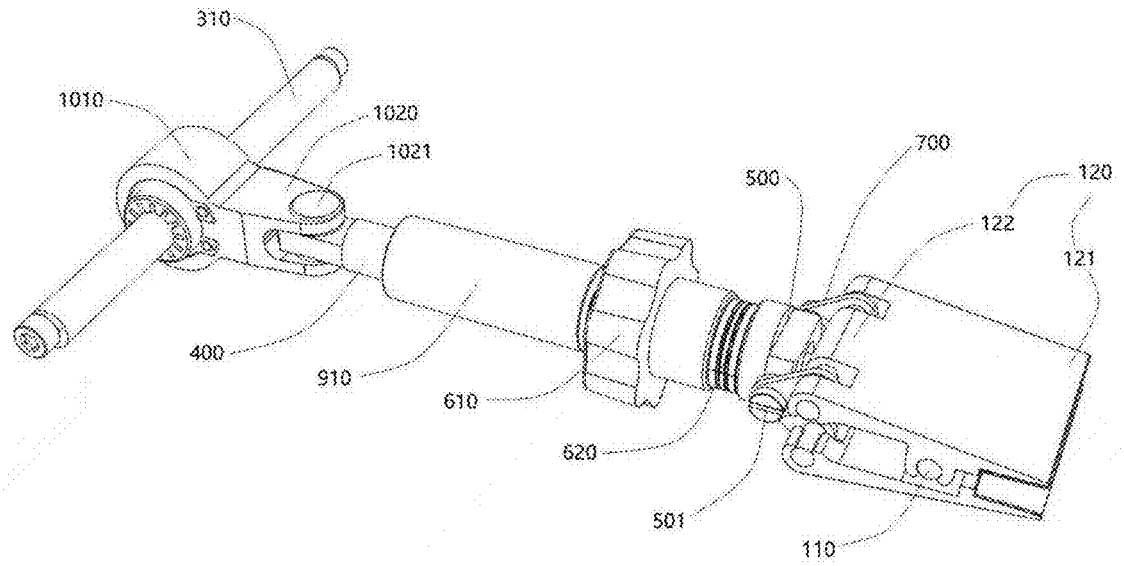
FIG. 4 is a schematic diagram of a three-dimensional structure of a clamping component in FIG. 1.

In the present disclosure, the number of the articulated rods 700 in the clamping component 100 can be selected according to needs. For example, in an implementation mode, as shown in FIG. 4, the bearing ring 500 is a ring-shaped closed body structure, and a pair of connecting ears 501 are symmetrically arranged on an outer circumference of the bearing ring 500. At the same time, two sets of articulated rods 700 are used, and the two sets of articulated rods 700 are symmetrically arranged on two sides of the bearing ring 500. Each set of articulated rods 700 include two articulated rods 700, and the two articulated rods 700 are symmetrically arranged in a mirror image. Each pair of articulated rods 700 connects the connecting ears 501 with the corresponding rear end 122 of the clamping arms, so that an axial displacement of the bearing ring 500 causes the two clamping arms 120 to be symmetrically tensioned, thereby making the clamped cutting tool to be center. After flipping the cutting tool, an angle between the blade and the grinding surface 211 remains unchanged.

The above is only preferred specific embodiment of the present disclosure, but the protection scope of the present disclosure is not limited to this. Any changes or substitutions that can be easily thought of by those skilled in the art within the technical scope disclosed in the embodiments of the present disclosure should be included in the protection scope of the present disclosure.

What is claimed is:

1. A sharpener, comprising:

a clamping component, which comprises two mirror symmetric clamping arms, wherein a middle of each of the clamping arms is connected together at a first rotating shaft;

a sharpening seat, configured to fix a sharpening stone, a working surface of the sharpening stone is a grinding surface;

a sharpener holder, which is configured to slide back and forth along an axial direction of the sharpening seat, the sharpener holder comprises a horizontal rod perpendicular to the axial direction of the sharpening seat and parallel to the grinding surface;

an arm body, one end of the arm body is sleeved on the horizontal rod and slides axially along the horizontal rod and pitches around the horizontal rod, and the other end of the arm body is fixedly connected at the first rotating shaft, and the first rotating shaft extending through aligned holes of the clamping arms and the second arm segment;

a bearing ring, which is coaxially sleeved outside the arm body and is clearance fit with the arm body, and a connecting ear is provided on an outer circumference of the bearing ring;

four articulated rods arranged symmetrically in two pairs, each of the articulated rods has a first end hinged to the connecting ear, and a second end hinged to a rear end of a respective clamping arm;

a driving component, which is provided on the arm body and configured to push the bearing ring to move axially along the arm body, thereby causing the two clamping arms to synchronously open and close through the symmetrical articulated rods to clamp or release a cutting tool;

wherein the driving component comprises a driving nut and a first thrust bearing.

2. The sharpener according to claim 1, wherein the driving nut—is coaxially sleeved on the arm body and forms a threaded engagement structure with an outer circumference of the arm body;

the first thrust bearing is coaxially sleeved on an outer wall of the arm body and is clearance fit with the arm body; the first thrust bearing is disposed between the driving nut and the bearing ring, and a first end face of the first thrust bearing being in contact with the driving nut, and a second end face, which is opposite to the first end face, being in contact with the bearing ring.

3. The sharpener according to claim 1, wherein the arm body comprises a first arm segment and a second arm segment that are arranged coaxially;

the sharpener further comprises a rotating sleeve component, and the rotating sleeve component comprises a rotating sleeve;

wherein the rotating sleeve and the first arm segment are in threaded engagement, and is matched with the second arm segment through a rotatable but axially limited connection, so that when the rotating sleeve is rotated, an axial distance between the first arm segment and the second arm segment is changed along the threaded engagement to adjust an effective length of the arm body and fine tune an angle between the cutting tool and the grinding surface.

4. The sharpener according to claim 1, wherein the arm body comprises a first arm segment and a second arm segment that is arranged coaxially with the first arm segment;

the sharpener further comprises a rotating sleeve component, and the rotating sleeve component comprises a rotating sleeve;

one end of the rotating sleeve is fixedly connected to the first arm segment, and the other end of the rotating sleeve is rotatably connected to the second arm segment;

when the first arm segment and the second arm segment rotate relative to each other, a total length of the arm body remains unchanged.

5. The sharpener according to claim 4, wherein the rotating sleeve is fixedly connected to the first arm segment, and one end of the second arm segment extends into the rotating sleeve and is clearance fit with the rotating sleeve;

the rotating sleeve component further comprises a second thrust bearing and a locking cap, wherein the second thrust bearing is provided inside the rotating sleeve, and two end faces of the second thrust bearing are respectively in contact with end faces of the first arm section and the second arm section;

the locking cap is detachably connected to the rotating sleeve and rotatably connected to the second arm segment to a limit an axial movement between the first arm segment and the second arm segment.

6. The sharpener according to claim 1, wherein anti-slip teeth and/or replaceable pads are provided on two opposite side walls of front ends of the two clamping arms.

7. The sharpener according to claim 1, wherein the sharpener further comprises a sliding guide component, and the sliding guide component comprises a sliding seat, a plurality of rolling elements, and two guide shafts fixed on the sharpening seat and extending along an axis of the sharpening seat, wherein the rolling elements comprise rollers or bearings;

the rolling elements are divided into two groups, each group corresponds to one guide shaft of the two guide shafts, and each rolling element having at least one annular groove on an outer circumferential surface thereof, the guide shaft of each group being in rolling cooperation with the annular grooves of the corresponding group of rolling elements so as to form a multi-point rolling support between the sliding seat and the guide shafts, thereby guiding the sliding seat to move axially along the sharpening seat; and the sharpener holder is fixed on the sliding seat.

8. The sharpener according to claim 7, wherein the sharpener holder comprises:

two parallel and spaced arranged side brackets, wherein each end of each of the two side brackets is fixedly connected to the sliding seat, each of the two side brackets is both provided with a respective through groove, and the two through grooves are parallel to each other;

two ends of the horizontal rod are respectively in contact with side walls of the two side brackets; and a locking bolt, which is arranged along an axis of the horizontal rod, and a body of the locking bolt passes through the through grooves and is detachably connected to the horizontal rod;

after connection, a head of the locking bolt presses against side walls of the side brackets.

9. The sharpener according to claim 7, wherein the sharpener holder comprises two parallel and spaced arranged side brackets, ends of the two side brackets are connected to the horizontal rod, and the other ends of the side brackets are articulated to the sliding seat;

wherein the sharpener further comprises an angle adjustment component, and the angle adjustment component comprises:

a second rotating shaft, which is configured to be a pivotal axis that connects the side brackets and the sliding seat;

two arc-shaped through grooves, each configured to be a through hole located on each of the side brackets respectively and extending around a circumference of the second rotating shaft;

a threaded hole, which is provided on a side wall of the sliding seat, a centerline of the threaded hole is parallel to a centerline of the second rotating shaft;

a threaded rod, one end of the threaded rod extends into the threaded hole and is connected to threaded hole by threads, and the other end of the threaded rod passes through the one of the two arc-shaped through grooves;

a butterfly nut, which is provided on one side of the side brackets facing away from the sliding seat and connected to the threaded rod by threads;

positioning holes, which are configured to be through holes provided on the side brackets, there are a plurality of positioning holes distributed around the circumference of the second rotating shaft;

a blind hole, which is provided on a side wall of the sliding seat and arranged parallel to the centerline of the second rotating shaft;

an ejector pin, one end of the ejector pin extends into the blind hole and is clearance fit with the blind hole, and the other end of the ejector pin is spherical and extends outside the positioning hole to contact the positioning hole;

a size of one side of the ejector pin outside the blind hole is larger than that of the positioning hole, so that only a part of the ejector pin is embedded in the positioning hole and is clearance fit the positioning hole; and a spring, wherein one end of the spring in contact with an inner bottom of the blind hole, and the other end thereof in contact with the ejector pin;

wherein when the side brackets rotate around the second rotating shaft, the ejector pin expands and contracts along an axis of the blind hole under an action of a spring force; and wherein when one end of the ejector pin outside the blind hole is facing the positioning hole, the ejector pin springs in to achieve indexing positioning.

10. The sharpener according to claim 7, further comprising:

two second limiting elements, and the two second limiting elements are arranged at intervals along an axis of the sharpener holder;

a first limiting element, which is provided on the sliding seat and between the two second limiting elements;

the first limiting element abuts against any one of the two second limiting elements during a reciprocating stroke to thereby limit a stroke movement and prevent the cutting tool from detaching from the grinding surface of the sharpening stone.

11. The sharpener according to claim 7, a cross-section of each of the annular grooves is U-shaped, V-shaped, or arc-shaped.

* * * * *